US006354895B1

(12) United States Patent
Van Riet

(10) Patent No.: US 6,354,895 B1
(45) Date of Patent: Mar. 12, 2002

(54) METHOD OF MOUNTING A DEFLECTION UNIT AROUND A CRT

(75) Inventor: Johannes J. M. Van Riet, Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/501,899

(22) Filed: Feb. 10, 2000

(30) Foreign Application Priority Data

Mar. 4, 1999 (EP) ..... 99200635

(51) Int. Cl.[7] ..... H01N 17/02; H01J 9/44

(52) U.S. Cl. ..... 445/3; 445/63

(58) Field of Search ..... 445/3 A, 3 B, 445/3 R, 63

(56) References Cited

U.S. PATENT DOCUMENTS 3,844,006 A * 10/1974 McGlashan ..... 445/3
4,803,559 A * 2/1989 Soemers ..... 445/3
4,902,258 A 2/1990 Dunsmore et al. ..... 445/23
5,873,759 A * 2/1999 Ball et al. ..... 445/3

* cited by examiner

*Primary Examiner*—Kenneth J. Ramsey

(57) ABSTRACT

Method in which the positions of the color ray tube and the deflection unit are matched to each other, using a step of recording a displayed image and in which the envelope is oriented upside down during matching.

5 Claims, 5 Drawing Sheets

METHOD OF MOUNTING A DEFLECTION UNIT AROUND A CRT

The invention relates to a method of mounting a deflection unit around a cathode ray tube.

Cathode ray tubes (CRTs) are used for example, in devices such as television apparatuses and computer monitors.

Positioning, also referred to as 'matching' the deflection unit and the envelope to each other is done during one of the final stages of manufacture. The deflection unit is positioned on the envelope, more precisely on the neck-cone transition part of the envelope which has all the elements needed for displaying an image on the display device. An image is formed on the display screen of the display device. The position of the deflection unit is varied in respect of the envelope so as to find the best, or at least an acceptable image reproduction, i.e. conforming to pre-set quality specifications, image reproduction, whereafter the positions of the deflection unit and envelope with respect to each other are fixed.

Such matching increases the quality of the image displayed by the display device. There is an ever increasing demand for high-quality image reproduction.

It is an object of the invention to provide a method with which, on average a better image reproduction can be obtained.

To this end, the invention provides a method of mounting a deflection unit around a cathode ray tube as defined by claim 1. The dependent claims define advantageous embodiments.

The inventors have realized that the known methods, in which the axis of the display unit is oriented substantially horizontally, may cause a shift in the position of the deflection unit in respect of the envelope after matching. The weight of the envelope and the deflection unit, especially for the ever increasing sizes of the display devices as currently employed, requires the means for varying the positions of the deflection unit and envelope vis-à-vis each other to counteract the forces of gravity. During matching (sometimes also referred to as alignment), the means therefore exerts a vertically oriented force on the deflection unit. To ensure that the deflection unit is indeed positioned against the envelope, the means often also apply some force in the horizontal direction. The forces by which the position of the deflection unit is actually varied are therefore superimposed on the forces to counteract the forces of gravity. This decreases the accuracy with which these last-mentioned forces may be applied and thereby the accuracy with which the deflection unit and envelope are positioned with respect to each other. Furthermore, once the positions are fixed, the means for varying the positions are released, thereby releasing the mentioned counteracting forces. A recoil of the deflection unit vis-a-vis the envelope may be the result of such a release. The means for fixation may comprise, on the one hand, parts of the deflection units or parts to be attached to the deflection unit and, on the other hand, devices for screwing, soldering, etc. The means for fixing may comprise for example, a clamping band by which one end of the deflection unit is clamped upon the neck portion of the envelope and means for fixing the clamping band, such as means for tightening a screw, and a wedge or wedges to be inserted between the other end of the deflection unit and the envelope, and means for soldering (for example, means for ultrasonic welding the deflection unit to the wedges.

In the method in accordance with the invention the tube axis is oriented vertically, with the neck portion being above the display screen. The neck portion is thus upwardly oriented. The display screen is positioned 'face-down'. When, in this position, the deflection unit is positioned on the envelope, the force of gravity does not need to be counteracted by the positioning means. In fact the force of gravity also supplies the force to position the deflection unit against the envelope. In contrast to the known methods, the starting position of the deflection unit at the start of the matching procedure is a stable one. This allows a much better 'fine-tuning' of the position. The forces needed for varying the position are not superimposed on relatively large forces to counteract the force of gravity or to push the deflection unit against the envelope. Preferably, the method in accordance with the invention comprises the step of measuring the image displayed by means of a measuring device located below the display screen, said measuring device supplying its data to a comparison device for comparing the data with standard data, said comparison device supplying data, in dependence on the measured data, to the means for varying the position. Although it is possible, within the invention in its broadest sense, to use human vision to inspect the image formed on the display screen, and regulate the position of the deflection unit, this would require either the use of a camera and inspection of the image on the camera, with a resulting loss of inspection quality, or inspection via a mirror, which would also mean a loss of inspection quality. The alternative, namely direct observation of the image would require the viewer to be positioned 'face-up' under the display screen, which position puts the viewer under great physiological stress and reduces the inspection quality.

Prior to engaging the means for varying the position of the deflection unit in respect of the envelope, the method preferable comprises, the step of positioning the envelope in respect of the recording means by way of envelope-positioning means. Such a (pre-)positioning improves the analysis of the reproduced image. Preferably, the means for positioning the envelope comprise a means for lifting the envelope, which means comprise bearings, preferably ball bearings upon which the envelope rests, and means for moving the envelope in at least two directions perpendicular to the tube axis. Since the tube axis is oriented substantially vertically , the envelope has a tendency to orient its tube axis as much as possible along a preferred, known vertical axis. In prior methods, where the tube axis is oriented substantially horizontally, the envelope will, have a tendency to tilt to an unknown degree unless relatively great counteracting forces are used. Thus, the measure increases the accuracy with which the envelope is oriented vis-a-vis the imaging means. The envelope can be brought into a good position very small and symmetrical forces.

These and other objects of the invention are apparent from and will be elucidated with reference to the embodiments described hereinafter.

In the drawings.

The Figures are not drawn to scale. In the Figures, like reference numerals generally refer to like parts.

Figure 1:
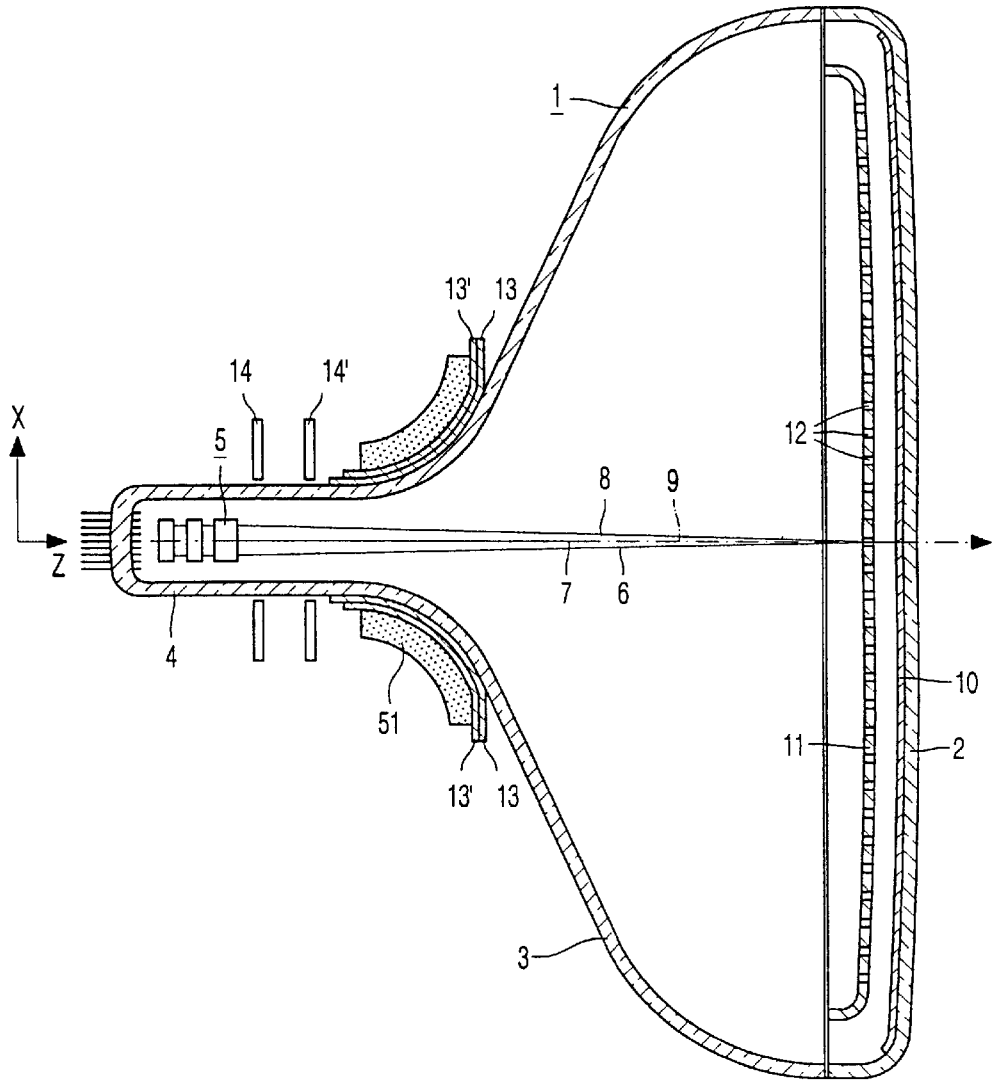
FIG. 1 is a sectional view of a display device.

The display device comprises a cathode ray tube, in this example a color display tube, having an evacuated envelope 1 which includes a display window 2, a cone portion 3 and a neck 4. The neck 4, accommodates an electron gun 5 for generating three electron beams 6, 7 and 8 which extend in one plane, the in-line plane, which is the plane of the drawing in this case. In the undeflected state, the central electron beam 7 substantially coincides with the tube axis 9. The inner surface of the display window is provided with a display screen 10. Said display screen 10 comprises a large number of phosphor elements luminescing in red, green and blue. On their way to the display screen, the electron beams are deflected across the display screen 10 by means of an electromagnetic deflection unit 51 and pass through a color selection electrode 11 which is arranged in front of the display window 2 and comprises a thin plate having apertures 12. The three electron beams 6, 7 and 8 pass through the apertures 12 of the color selection electrode at a small angle relative to each other and hence each electron beam impinges only on phosphor elements of one color. In addition to a coil holder 13, the deflection unit 51 comprises, coils 13' for deflecting the electron beams in two mutually perpendicular directions, and a yoke core of a magnetizable material. The display device further includes means for generating voltages which, during operation, are fed to components of the electron gun via feedthroughs.

Figure 2:
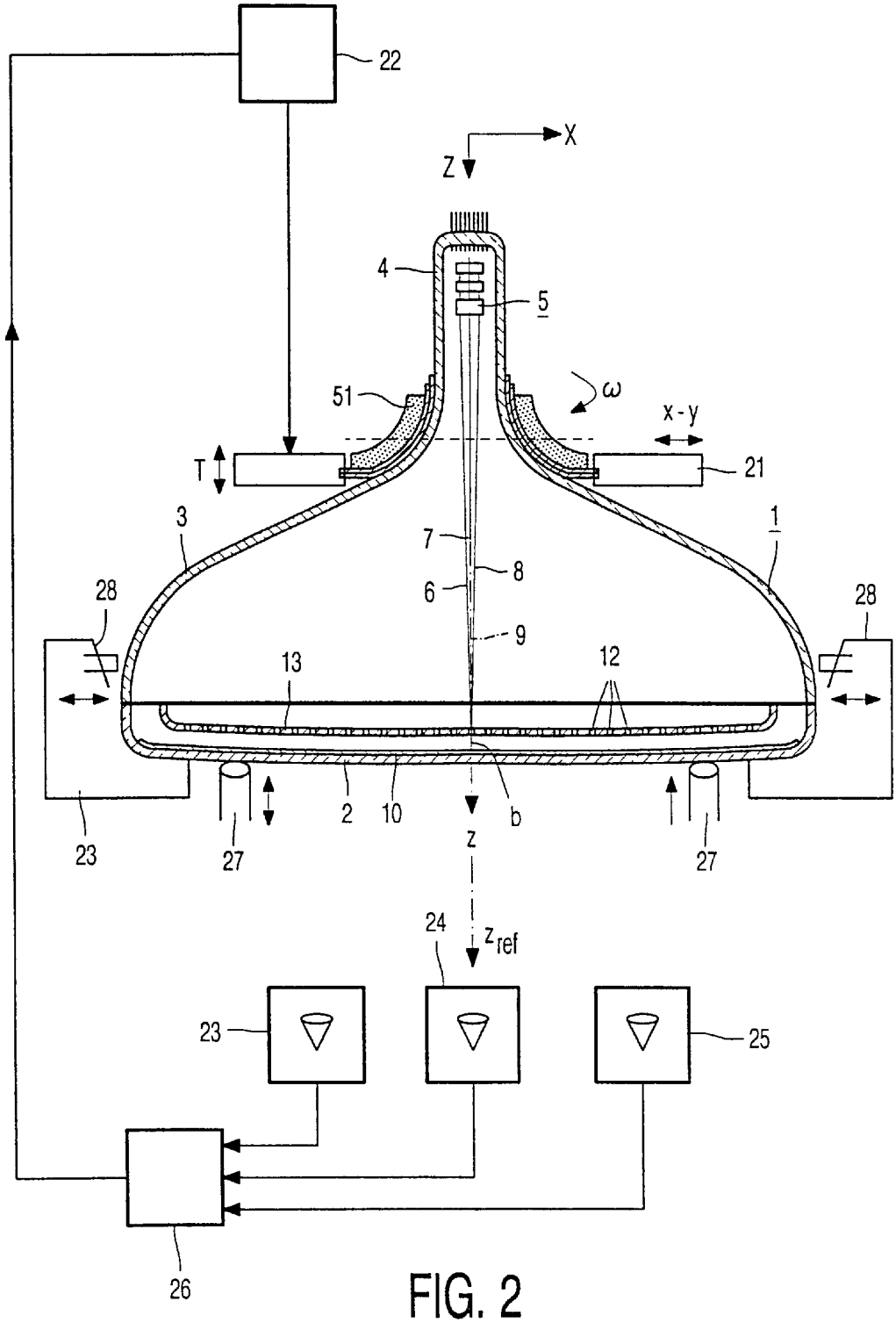
FIG. 2 illustrates a method in accordance with the invention.

FIG. 2 illustrates an embodiment of the method in accordance with the invention. The envelope is positioned 'face-down', i.e. with the neck upwardly oriented. The deflection unit is held by means 21 by which the position of the deflection unit can be adjusted vis-à-vis the envelope 1. The position of means 21 with respect to a table 23, in which and by which the envelope is held in a fixed position, is known and regulated. For example, the deflection unit can be rotated through an angle ●, translated through distances in the x and y directions, i.e. perpendicular to the tube axis, and tilted through a tilt T in any of the directions x and y.

The data for the movements of the means 21 are supplied by a means 22. This means in its turn is provided with data 26 supplied by measuring means, in this example a number of cameras 23, 24 and 25. In this example, three cameras are shown. Within the concept of the invention, any number (one or more) of cameras may be used. Preferably, the cameras are provided beneath the envelope. For very large sizes, the distance between the cameras and the envelope may, however, be relatively large. In such circumstances, the cameras may be placed below and to the side of the envelope, the light paths between the envelope and the cameras being folded by means of mirrors. In means 22 (or in means 26), the measured image data are compared with a or several standards. The difference between the standards and the measured data are used to generate data for movement (in any one of or a number of the indicated directions) of deflection unit 51 by means 21. This process may be repeated several times until a satisfactory image is produced, whereafter the positions of the deflection unit and the envelope with respect to each other are fixed and means 21 releases the deflection unit. Means 21 does not have to support the weight of the deflection unit, and the forces necessary for the movement are not superimposed on other forces. The set-up shown in FIG. 2 also comprises means 27 by which the envelope can be tilted. These means comprise bearings, for instance ball bearings on which the envelope rests. Means 28 are provided by which the envelope can be moved in the x and y directions. The forces needed to move in the x-direction are grosso modo the same as those needed to move the envelope in the y direction. Such alignment means enable the envelope to orient its tube axis along the z-axis, and to be moved to an aligned position in respect of the cameras with very little force. The position of the envelope with respect to the cameras can thus easily be controlled fast and with great accuracy. This z-axis and x-y alignment is preferably done prior to further alignment of envelope and deflection unit in respect of each other. If, as in prior-art methods, the envelope is oriented horizontally, there is a natural tendency of the envelope to tilt and it requires large forces to keep the envelope in its position and move it, which forces are different for different orientations.

Figure 3:
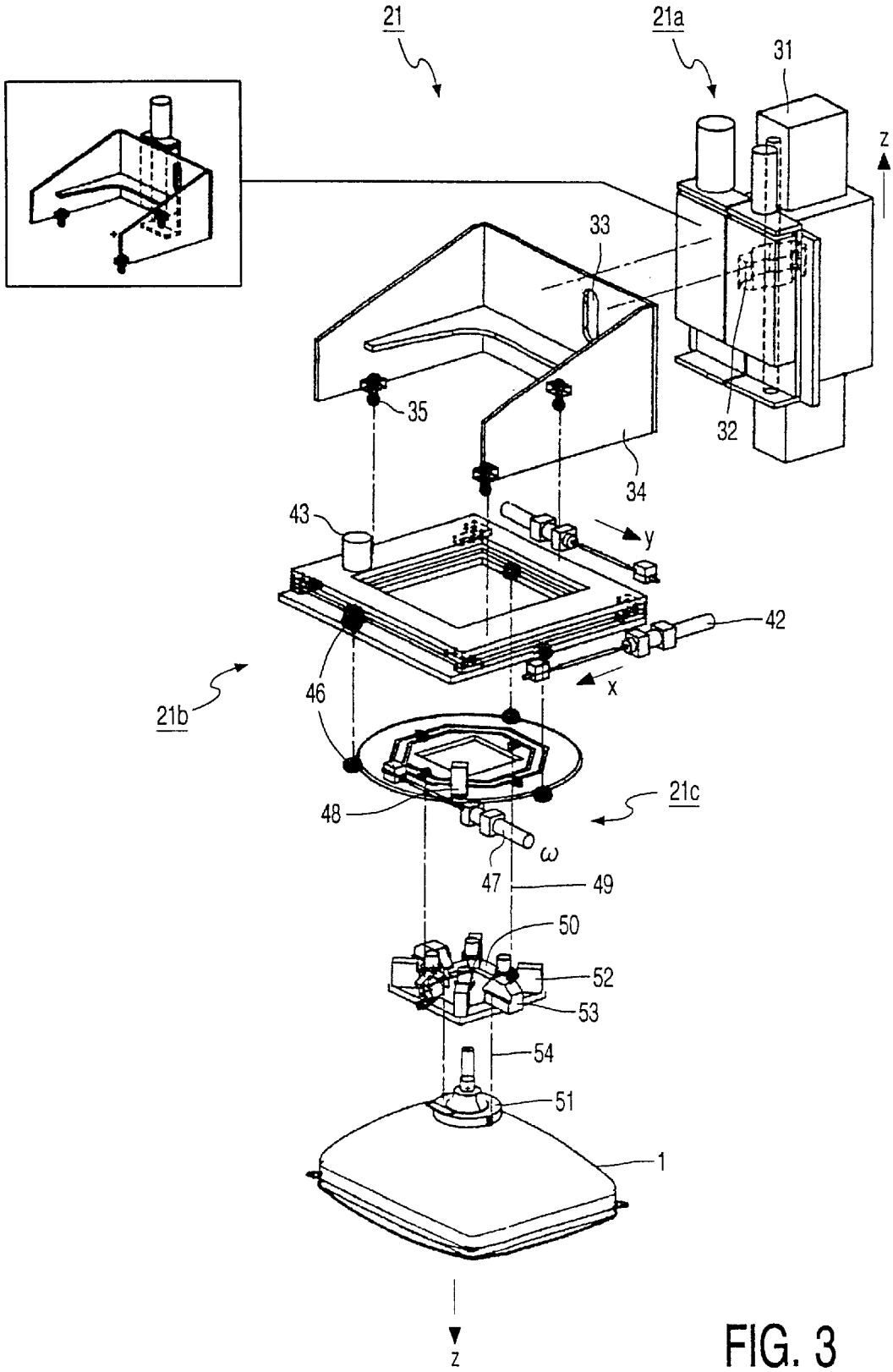
FIG. 3 illustrates, in more detail, an embodiment of the method in accordance with the invention.
Figure 4:
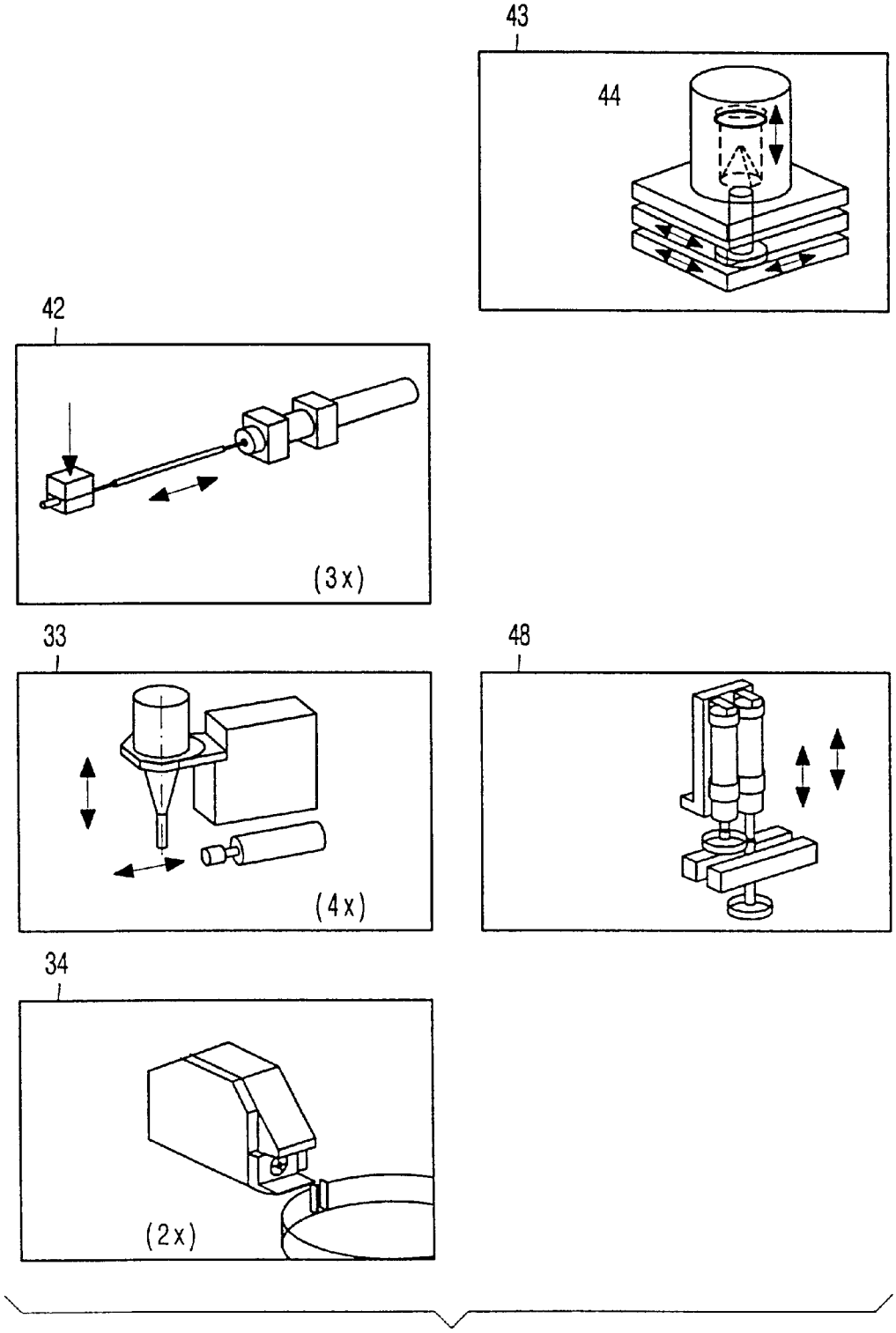
FIG. 4 illustrates some parts of the device used in the embodiment of the invention as shown in FIG. 3.

FIG. 3 shows a means 21 in detail. The means 21 comprise a means 21*a* to regulate the z position of the deflection coil. A post 31 is attached to clamps 31 (see FIG. 4). The post 31 comprises an element 32 the z position of which can be regulated by a stepping or servo motor. The element 32 is inserted through an aperture 33 in a holder 34. Thus, the z position of the holder 34 can be regulated. The holder 34 is provided with fastening means 35 to fasten the holder 34 to a means 21*b*. Means 21*b* regulates the x and y positions. To this end, the means comprise three linear motion devices 42 by which the x and y position can be regulated. To ensure that the starting point is the same for each regulation an x-y reset means 43 is provided. This means comprises a means 44 with a hole and a pin 45. By lowering the means 44, the pin (to which further parts of means 21*b* are attached) is forced into a fixed (reset) position. Means 21*b* comprises coupling elements 46 by which means 21*c* are coupled to means 21*b*. These means enable a rotating movement ● to be made. A motion device 47 is provided for this purpose. Also a reset device 48 is provided. Means 21*c* comprise coupling elements 49 coupling said means to a work station 50 comprising soldering means 52 and coil clamps 53. The work station 50 is coupled to the deflection unit 51 via coupling elements 54. In this example, the deflection unit will be welded (by means of ultrasonic welding the deflection unit on the envelope) to elements fixed on the envelope.

The method described by way of example comprises this steps of resetting the x-y-z and ● positions of the means 21*a*, 21*b* and 21*c*, followed by coupling the means and the deflection unit to each other, measuring the image on the display screen, and finding the correct x-y-z and ● positions, whereafter the relative position of deflection unit and the envelope are fixed. The correct x-y-z and ● positions can be found in several ways. If the relation between certain errors, such as image distortion and/or focusing errors, and the relative position is roughly known, the required changes in x-y-z-● positions can be calculated in a first-order approximation. After changing the x-y-x-● positions, a new measurement is made and the process is repeated. It is also possible to successively perform a number of measurements, change one parameter to find the optimum value for said parameter, set said parameter at said optimum value, followed by changing another parameter, finding the optimum value, etc. etc.

Figure 5:
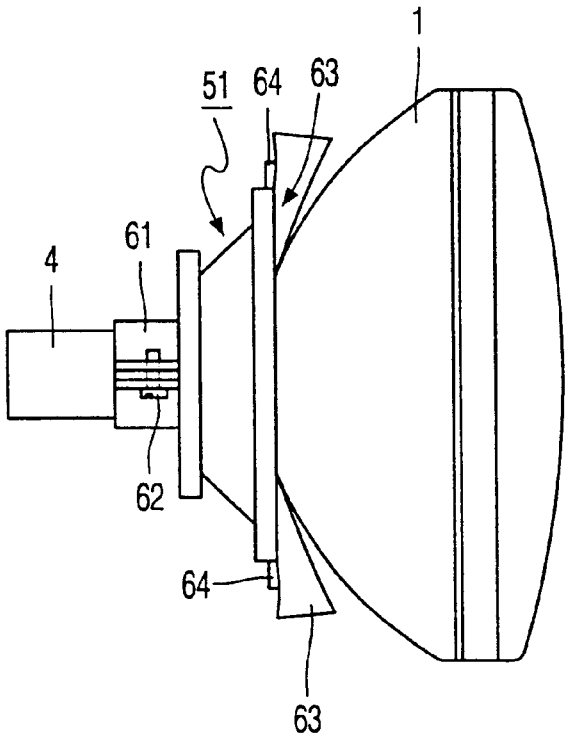
FIG. 5 shows an envelope and a deflection unit with a clamping band on one side and wedges between the deflection unit and the envelope.
Figure 6:
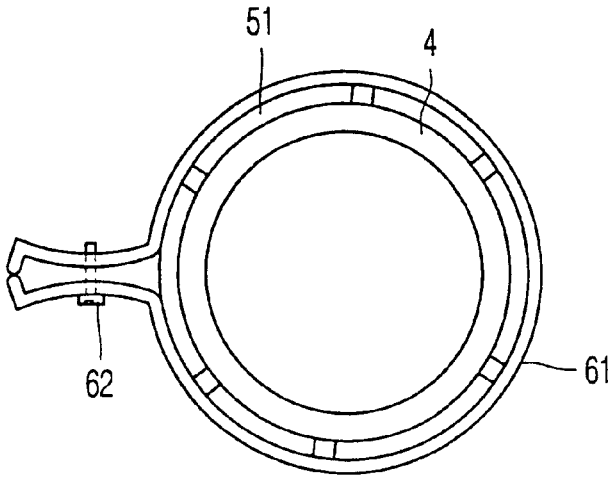
FIG. 6 shows a clamping band.

FIG. 5 shows an envelope 1 on which a deflection unit 51 is provided. A part of the deflection unit around the neck portion 4 of the envelope is surrounded by a clamping band 61, which is shown in more detail in FIG. 6, by means of a screw 62. The deflection unit and envelope are aligned as follows. First, the optimum, or at least acceptable, z-position of the deflection unit with clamping band is determined, the clamping band is screwed on the neck portion of the envelope, and thereafter the optimum, or at least acceptable x-y positions are determined, which, since the clamping band is fixed, will also slightly tilt the deflection unit vis- à-vis the envelope. When the correct positions are obtained, wedges 63 are provided on the other end of the deflection unit 51, which wedges hold the deflection unit in a fixed position vis-à-vis the envelope. The deflection unit 51 is provided with attachment parts 64 formed for example, as extensions of a coil holder. These attachment parts are fixed to the wedges, for example by means of ultrasonic soldering. This fixes the relative positions of the deflection unit and the envelope.

In summary the invention relates to a method in which the positions of the envelope and the deflection unit are matched to each other, using a means for recording a displayed image, and in which the envelope is oriented upside down during matching.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of other elements or steps than those listed in a claim. The word "a" or "an" preceding an element does not exclude the presence of a plurality of such elements.

What is claimed is:

1. A method of mounting a deflection unit (51) around a cathode ray tube, the cathode ray tube comprising a display screen (10) and a neck (4) having a central axis defining a tube axis (9), the method comprising the steps of:

positioning the cathode ray tube with the tube axis (9) oriented substantially vertically and the neck (4) above the display screen (10), placing the deflection unit (51) around the cathode ray tube, generating an image on the display screen (10) to obtain a displayed image, recording the displayed image with a recording means, varying the position of the deflection unit (51) with respect to the cathode ray tube in dependence upon the displayed image, and fixing the deflection unit (51) and the cathode ray tube with respect to each other.

2. A method as claimed in claim 1, wherein the method further comprises the step of measuring the displayed image by means of a measuring device (23,24,25) located below the display screen (10), said measuring device supplying data to a comparison device (22,26) for comparing the data with standard data, said comparison device (22,26) supplying data, in dependence on the measured data, to positioning means (21) for varying the position of the deflection unit with respect to the cathode ray tube.

3. A method as claimed in claim 1, wherein, prior to the step of varying the position of the deflection unit (51) with respect to the cathode ray tube, the cathode ray tube is positioned with respect to the recording means by means of tube positioning means.

4. A method as claimed in claim 3, wherein the tube positioning means comprise a lifting means (27) for lifting the cathode ray tube having bearings, preferably ball bearings upon which the cathode ray tube rests, and moving means (28) for moving the cathode ray tube in at least two directions perpendicular to the tube axis.

5. A method as claimed in claim 1, wherein the step of varying the position of the deflection unit with respect to the cathode ray tube in dependence upon the displayed image is done by way of position varying means that comprise reset means (43) to reset at least a part of the position varying means to a known position.

* * * * *